US007721904B2

(12) United States Patent
Fleenor

(10) Patent No.: US 7,721,904 B2
(45) Date of Patent: May 25, 2010

(54) HYDRAULIC TANK ACCESS COVER WITH SELF-CENTERING AND ANTI-ROTATION DEVICE

(76) Inventor: Jeff Fleenor, 2139 Elk Horn, Pella, IA (US) 50219

( * ) Notice: Subject to any disclaimer, the term of this patent is extended or adjusted under 35 U.S.C. 154(b) by 1325 days.

(21) Appl. No.: 11/073,822

(22) Filed: Mar. 7, 2005

(65) Prior Publication Data

US 2005/0205573 A1 Sep. 22, 2005

Related U.S. Application Data

(60) Provisional application No. 60/550,598, filed on Mar. 5, 2004.

(51) Int. Cl.
*B65D 45/00* (2006.01)
*B65D 53/00* (2006.01)

(52) U.S. Cl. ..... 220/233; 220/327; 220/255; 220/582

(58) Field of Classification Search ..... 220/327, 220/233, 255, 256.1, 565, 243, 601, 661, 220/562, 651, 582
See application file for complete search history.

(56) References Cited

U.S. PATENT DOCUMENTS

| | | | | | |
|---|---|---|---|---|---|
| 864,605 | A * | 8/1907 | Brain | 220/243 |
| 888,255 | A * | 5/1908 | Osborne | 220/243 |
| 941,533 | A * | 11/1909 | Pelletier | 220/601 |
| 1,191,432 | A * | 7/1916 | Jones | 49/61 |
| 2,037,347 | A * | 4/1936 | Shoop | 220/248 |
| 2,283,066 | A * | 5/1942 | Ingersoll | 220/243 |
| 2,448,838 | A * | 9/1948 | Sohnlein | 220/251 |
| 3,084,827 | A * | 4/1963 | Dyer | 220/251 |
| 3,469,490 | A * | 9/1969 | Pearce, Jr. | 411/371.1 |
| 4,701,088 | A * | 10/1987 | Crull | 411/369 |
| 5,188,495 | A * | 2/1993 | Jones, Jr. | 411/369 |
| 7,044,701 | B2 * | 5/2006 | Herb | 411/84 |

* cited by examiner

*Primary Examiner*—Robin Hylton
(74) *Attorney, Agent, or Firm*—Kent A. Herink; Emily E. Harris

(57) ABSTRACT

A hydraulic access cover assembly for a hydraulic reservoir tank that provides a self-centering and anti-rotation feature for quick and positive sealing of the tank. Tabs located on the inner cover interlock with tabs incorporated into the tank access hole to provide the self-centering and anti-rotation features. This system eliminates the need to weld anything to the tank, which eliminates a potential contamination source of the hydraulics.

9 Claims, 3 Drawing Sheets

Fig. 1a
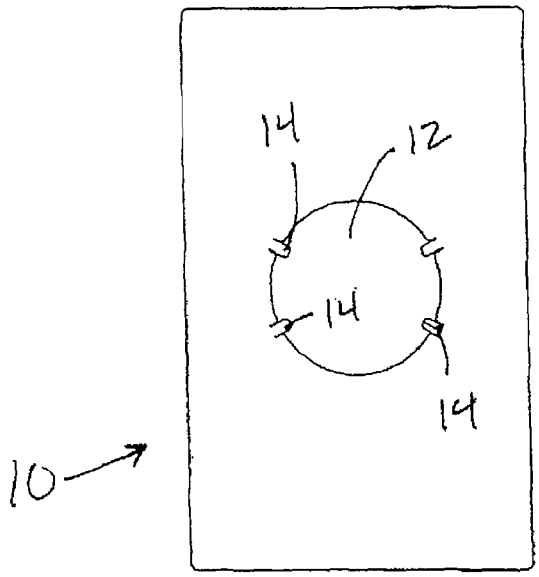
Fig. 1b
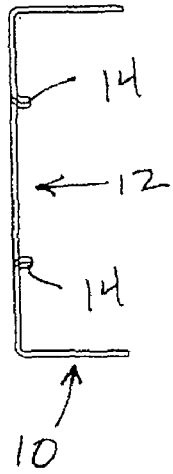
Fig. 2b
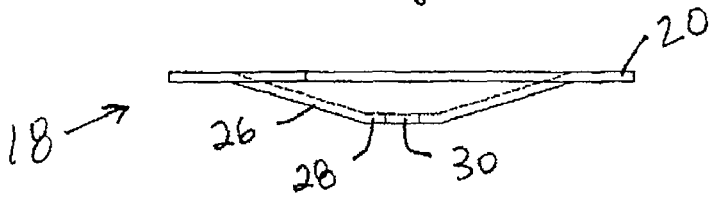
Fig. 2c
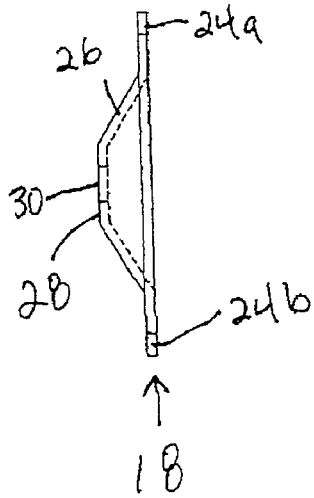
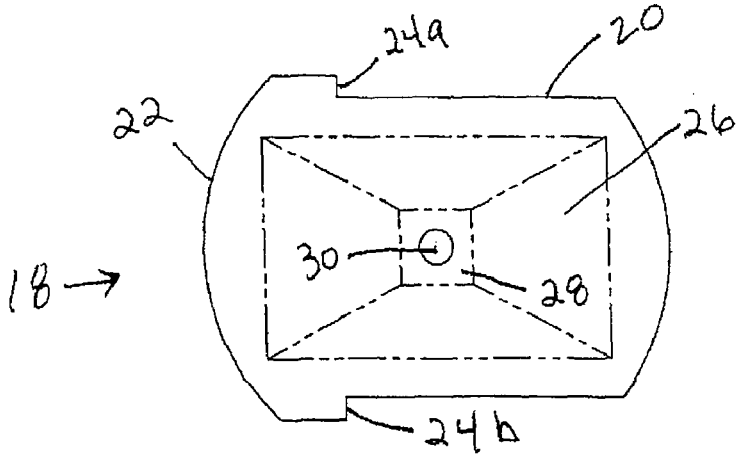
Fig. 2a

HYDRAULIC TANK ACCESS COVER WITH SELF-CENTERING AND ANTI-ROTATION DEVICE

This application claims priority to U.S. Provisional Patent Application Ser. No. 60/550,598 filed Mar. 5, 2004.

BACKGROUND OF THE INVENTION

The invention relates generally to covers for the access holes of hydraulic tanks and, more specifically, to a hydraulic tank access cover that has a self-centering and anti-rotation feature.

Mobile construction equipment use hydraulic systems for many uses such as ground drives, hydraulic cylinder activation and hydraulic motor power. These hydraulic systems typically operate at high pressure making them very sensitive to contamination. The hydraulic reservoirs used in these systems need to be thoroughly cleaned before filling with hydraulic oil, otherwise severe contamination can result in excessive pump wear, valve sticking, cylinder scoring, seal tearing, and ultimately total system failure. Having an access hole to be able to clean out the tank before use or even after a system failure has happened can prevent costly future failures.

Hydraulic tank access holes need to be able to be sealed completely such that they do not leak hydraulic oil even when under a given pressure load. Common in the industry are sealing systems which include welding a tapped flange around the hole with blind tapped holes that can hold a gasket and lid bolted down. A second common method is to weld nuts on the underside of the tank surface around the perimeter of the hole to bolt down a lid. Still another form is an outer cover that bolts through the center to a threaded receptacle bolted inside the tank to a gusset or baffle that is welding across the center of the hole inside the tank. All of these methods require expensive machined parts, excess fabrication time, and welding to the inside of the tank. The welding process itself generates a very undesirable form of metal contaminates in the form of weld splatter, weld slag, and flaked off mill scale that are extremely hard on hydraulic systems to the point that a new machine will fail as it drives off the assembly line. An access cover that eliminates welding altogether to the tank has a huge advantage in not generating metal contaminates to begin with.

SUMMARY OF THE INVENTION

The access cover system of the present invention has the advantage that no internal or external welding is required to the tank itself, thus eliminating the possibility of weld generated contamination. The invention has an additional advantage in that it self centers and has an internal anti-rotation feature that allows fast assembly times with air impact guns.

A hole is generated in the tank during the fabrication stage by laser, water jet, or plasma cutting method. It is during this same cutting stage that a tab is cut without introducing any extra material or pierce time, which would negatively add cost. These tabs are later bent inward before final assembly to provide the anti-rotation feature. The cover assembly consists of an outer plate, a gasket and an inside cover plate. A center hole in all parts allows a flanged bolt to pass through the outer cover gasket and thread into the inner cover plate. The inside cover plate is inserted into the hole of the tank between the tabs and moved backwards until the side tabs of the inner plate come into contact with the tabs of the tank itself. At this point the outer cover is centered over the tank hole and the bolt is tightened down. The gasket seals around the outer edge of the outer cover. A captured O-ring completes the seal under the flange of the bolt.

BRIEF DESCRIPTION OF THE DRAWINGS

FIGS. 1*a* and 1*b* are a plan view and a side view, respectively, of a hydraulic tank showing an access hole modified in accordance with the present invention.

FIGS. 2*a-c* are plan, side section, and end section views, respectively, of an inside cover plate of the present invention.

DETAILED DESCRIPTION OF A PREFERRED EMBODIMENT

Figure 3B:
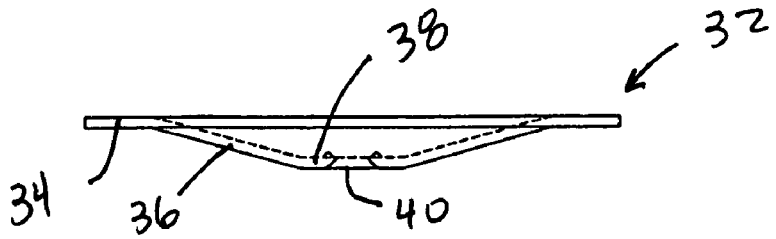
FIGS. 3*a* and 3*b* are a plan view and a side view, respectively, of an outside cover plate of the present invention.

Illustrated in FIGS. 1*a* and 1*b*, generally at 10 is a section of a hydraulic tank for use in holding hydraulic fluid for a hydraulic system such as on an earth moving machine. The tank 10 includes an access hole 12 having a generally circular profile. The opening 12 includes a plurality of tabs 14 spaced around the periphery of the access opening. The tabs 14 are cut out of a sheet of metal during fabrication of the access opening 12 having the profile as illustrated in FIG. 1*a*, and then bent downwardly so that the end portions 16 extend below the underside surface of the tank 10, as shown in FIG. 1*b*. This arrangement of the tabs 14 leaves the opening 12 essentially round which facilitates effective sealing of the opening 12.

The invention includes an inside cover plate 18 (FIG. 2). The inside cover plate 18, in a preferred embodiment, has a profile that includes a rectangular portion 20 and a curvilinear portion 22. The rectangular portion 20 transitions into the curvilinear portion 22 by way of a pair of shoulder sections 24*a* and 24*b*. A central portion 26 of the inside cover plate 18 projects downwardly in the form of a truncated, four-sided pyramid, including a lower, flat portion 28 that is perforated by a bolt hole 30.

Figure 3A:
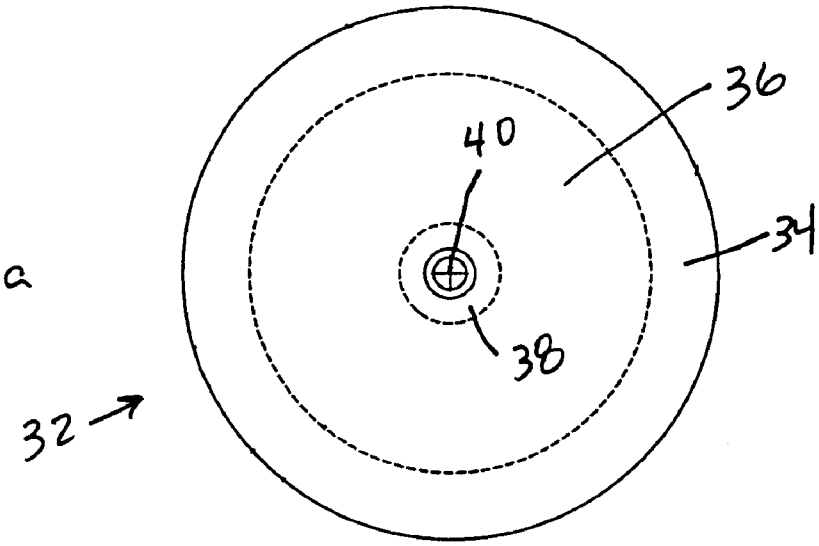
Figure 4A:
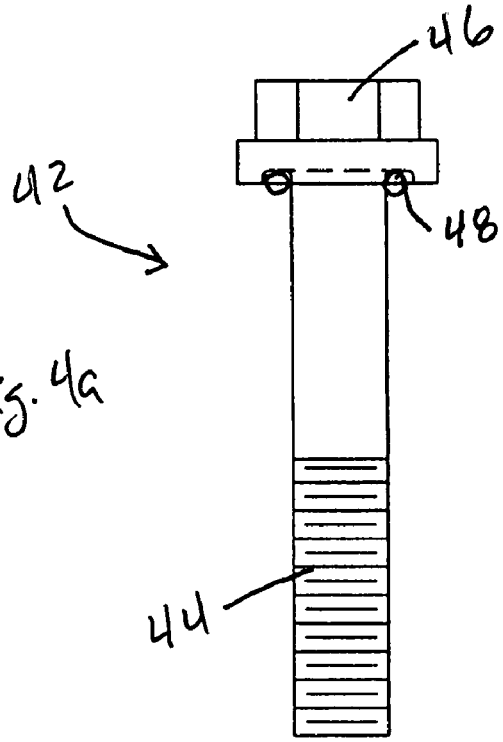
FIG. 4*a* is a side view of a bolt for use with the present invention showing in hidden line a recess for receiving an O-ring.
Figure 4B:
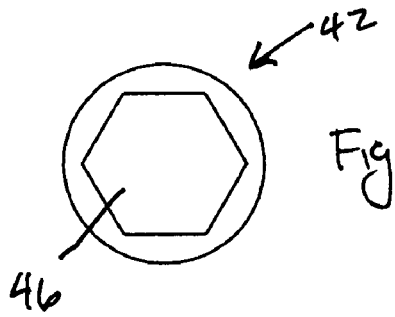
FIGS. 4*b* and 4*c* are end views of the bolt.
Figure 4C:
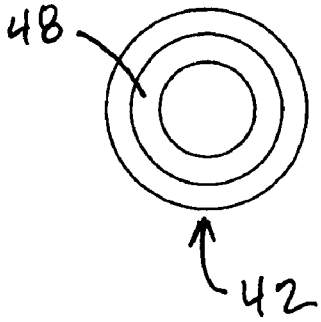

An outside cover plate 32 (FIG. 3) is generally circular in profile having a planar outer peripheral flange 34 of an annular shape. A central portion 36 of the outside cover plate 32 projects upwardly and forms a frustoconical shape having a flat top portion 38 that is perforated by a bolt hole 40. A bolt 42 (FIG. 4) is used in assembling the inside cover plate 18 and outside cover plate 32 to seal the access opening 12 of the hydraulic tank 10. The bolt 42 includes a threaded end portion 44, a hexagonal head 46 the underside of which includes a circular recess 48 in which is received a sealing gasket, such as an O-ring, for sealing the bolt hole 40. The recess 48 assures that the O-ring will be retained inside the recess 48 and will not be damaged by the bolt 42 as it is tightened to seal the opening 12. The recess 48 is of a size to accommodate an O-ring that is slightly larger than the bolt hole opening 40 so that the combination of the bolt 42 and O-ring will seal the bolt hole opening 40.

Figure 5:
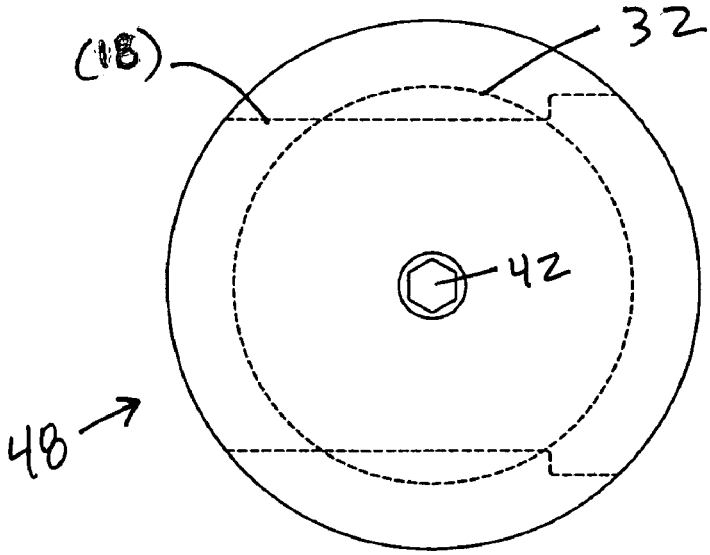
FIG. 5 is a plan view of the completed assembly of the present invention showing the inside cover plate and the outline of the hydraulic tank access opening shown in hidden line.
Figure 6:
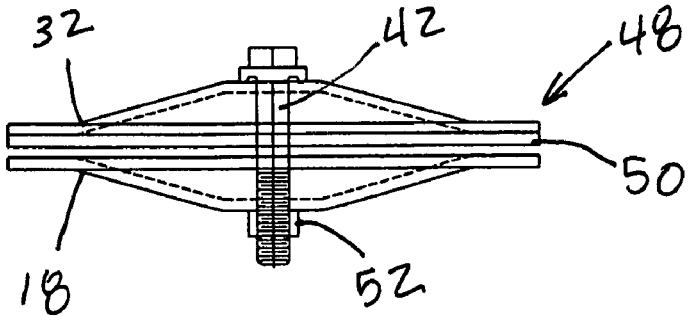
FIG. 6 is a sectional view taken along line 6-6 of FIG. 5.

The assembled cover is illustrated in FIGS. 5 and 6, generally at 54. A gasket 50 is positioned between the inside cover plate 18 and the outside cover plate 32 and the bolt holes 30 and 40 are aligned. In the preferred embodiment, a threaded nut 52 has been secured to the underside of flat portion 28 of the inside cover plate 18 in coaxial alignment with the bolt hole 30. The bolt 42 is then inserted through the bolt hole 40 and the threaded end portion 44 is received in threaded engagement with the nut 52. The bolt 42 is tightened to pull the two cover plates 18 and 32 toward each other to provide a seal.

In assembling the cover 54 to seal an access opening 12, cover 54 is assembled as shown in FIGS. 5 and 6, with the bolt 42 loosened so that there is a sizeable gap between the two cover plates 18 and 32. The gasket 50 and cover plates 18 and 32 should be inspected for any cuts or loose material that could be allowed into the tank 10. Slip one corner of the inside cover plate 18 with the rectangular portion 20 in between two of the locating tabs 14 of the opening 12 in the tank 10. The cover 48 is then moved to bring the inside cover plate 18 fully inside the tank 10. The cover 48 is moved to bring a pair of the tabs 14 into contact with the shoulders 24 of the inside cover plate 18. The spacing of the tabs 14 and the contact of the tabs 14 with the shoulders 24 provide both a self-centering function and will restrain the inside cover plate 18 against rotation as the bolt 42 is tightened. Once the inside cover plate 18 is in position, the bolt 42 is tightened to bring the inside cover plate 18 into contact with the underside of the hydraulic tank 10 and the outside cover plate 32 into contact with and pressing on the gasket 50 into sealing engagement with the top surface of the hydraulic tank 10. The O-ring of the bolt 42 will also engage and seal the perimeter of the bolt hole 40 of the outside cover plate 32. It is to be noted that the shape of the cover plates 18 and 32 permit compression of the cover plates 18 and 32 toward each other by tightening of the bolt 42 and thus act as a spring to preload the bolt 42 and thereby improve the seal created and help to prevent creep of the gasket 50. In this way, a single bolt with O-ring seal is used to create enough compressive load to seal the outer gasket perimeter. In addition, the O-ring containment system provided by the recess 48 allows a metal to metal contact of the flange bolt 42 with the outside cover plate 32 to achieve a bolt torque clamp load to hold bolt tension over time. The prior art uses a nylon crush washer which creeps over time due to compression set of the high compressive stress and then leaks. Further, the formed outer edge of the inner cover plate 18 increases the stiffness of the plate 18 to resist a much greater load induced on the plate 18 by the center flange bolt 42 than that which could be resisted by a flat plate alone. This allows a thinner material to be used, which reduces both cost and weight.

Figure 7B:
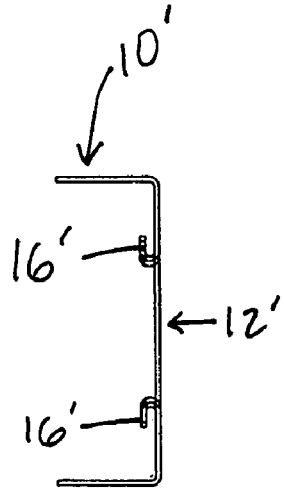
FIGS. 7*a* and 7*b* are a plan view and a side view, respectively, of a hydraulic tank showing an access hole modified in accordance with an alternative embodiment of the present invention.
Figure 7A:
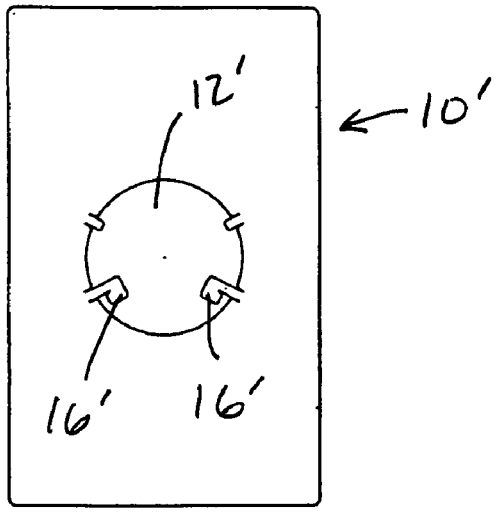

In an alternative embodiment, an opening 12' of a hydraulic tank 10' is formed with tabs 14' that are not only bent downwardly as in the first embodiment, but also are bent inwardly, as illustrated in FIG. 7 at 16'. The free end portions 16' of the tabs 14' will provide a support of the inside cover plate 18 so that if, during assembly or disassembly, the bolt 42 slips out of threaded engagement with the inside cover plate 18, it will not drop into the hydraulic tank 10'. 15.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

I claim:

1. A cover assembly for sealing the opening of a hydraulic fluid tank, the assembly comprising:

(a) a tab formed from the tank and projecting from the periphery of the tank opening into the interior of the tank;

(b) an inside cover plate positioned inside the tank having a reduced width section forming a laterally projected shoulder in contact engagement with the tab;

(c) an outer cover plate positioned outside the tank; and (d) a bolt, interconnecting the inside cover plate and the outside cover plate, which is rotated to bring simultaneously the inside cover plate and the outside cover plate into sealing engagement about the periphery of the opening and wherein the tab prevents the inside cover plate from rotating in response to rotation of the bolt.

2. A cover assembly as defined in claim 1, further comprising a gasket interposed between the outside cover plate and the tank.

3. A cover assembly as defined in claim 2, further comprising a bolt hole in the outside cover plate and a recess formed in the bolt.

4. A cover assembly as defined in claim 3, wherein the recess holds a sealing gasket.

5. A cover assembly as defined in claim 4, wherein the recess positions the sealing gasket outside the perimeter of the bolt hole whereupon rotation of the bolt to seal the tank opening also seals the bolt hole.

6. A cover assembly as defined in claim 1, further comprising a section of the tab projected along the underside of the inside cover plate to prevent the inside cover plate from falling if the bolt is removed.

7. A cover assembly as defined in claim 1, wherein the inside cover plate comprises a perimeter flange for engaging an inside surface of the tank and a central portion that extends inwardly away from the inside surface of the tank.

8. A cover assembly as defined in claim 1, wherein the outer periphery of the outer cover plate is flat.

9. A cover assembly as defined in claim 1, wherein the tab is of a generally L-shape having a downwardly extended section and an inwardly extended section.

* * * * *